US008311257B2

(12) United States Patent
Hu

(10) Patent No.: US 8,311,257 B2
(45) Date of Patent: Nov. 13, 2012

(54) EARPHONE MOUNTING STRUCTURE

(76) Inventor: Chiu-Yueh Hu, Taipei (TW)

( * ) Notice: Subject to any disclaimer, the term of this patent is extended or adjusted under 35 U.S.C. 154(b) by 241 days.

(21) Appl. No.: 12/908,182

(22) Filed: Oct. 20, 2010

(65) Prior Publication Data

US 2012/0099755 A1 Apr. 26, 2012

(51) Int. Cl.
*H04R 21/02* (2006.01)

(52) U.S. Cl. ..... 381/367; 381/376; 381/301; 381/333; 381/364; 381/388

(58) Field of Classification Search ..... 381/301, 381/333, 364, 388, 367, 376, 189, 332, 336
See application file for complete search history.

(56) References Cited

U.S. PATENT DOCUMENTS 4,439,643 A * 3/1984 Schweizer ..... 381/395
5,647,007 A * 7/1997 Wooderson et al. ..... 381/332
6,683,963 B2 * 1/2004 Sterns et al. ..... 381/182

* cited by examiner

*Primary Examiner* — Curtis Kuntz
*Assistant Examiner* — Amir Etesam
(74) *Attorney, Agent, or Firm* — Rosenberg, Klein & Lee

(57) ABSTRACT

An earphone mounting structure includes an earphone consisting of a flat base frame shell, a speaker, a cover frame shell capped and a detachable decorative cap shell, and a mounting device adapted for securing the earphone to a cap for the head of a person. The mounting device can be formed of a snap fastener, a clamping device, or pads of hook and loop materials, enabling the earphone to be conveniently and detachably fastened to the user's cap.

9 Claims, 6 Drawing Sheets

EARPHONE MOUNTING STRUCTURE

BACKGROUND OF THE INVENTION

1. Field of the Invention

The present invention relates to earphone technology and more particularly, to an earphone mounting structure, which comprises an earphone consisting of a flat base frame shell, a speaker, a cover frame shell capped and a detachable decorative cap shell, and a mounting device adapted for securing the earphone to a cap for the head of a person. The mounting device can be formed of a snap fastener, a clamping device, or pads of hook and loop materials, enabling the earphone to be conveniently and detachably fastened to the user's cap.

2. Description of the Related Art

Many different types of earphones and headphones are commercially available. A headphone generally comprises a pair of loudspeakers and a headband connecting the loudspeakers to hold them close to a user's ears for listening to music. However, it is inconvenient or uncomfortable to wear a headphone when a person is wearing a cap.

SUMMARY OF THE INVENTION

The present invention has been accomplished under the circumstances in view. It is one object of the present invention to provide an earphone mounting structure, which enables user to detachably fasten an earphone to his (or her) cap.

To achieve this and other objects of the present invention, an earphone mounting structure comprises an earphone, and a mounting device adapted for securing the earphone to a cap for the head of a person. The earphone comprises a flat base frame shell, the flat base frame shell comprising an annular flange protruded from a front side thereof, a speaker accommodation chamber surrounded by the annular flange and a plurality of arched hook flanges protruded from a back side thereof corresponding to the annular flange, each arched hook flange having a hooked portion, a speaker mounted in the speaker accommodation chamber, a cover frame shell capped on the annular flange and affixed to the flat base frame shell by screws to hold down the speaker in the speaker accommodation chamber, and a detachable decorative cap shell capped on the cover frame shell. The mounting device comprises a first clamping member and a second clamping member. The first clamping member comprises a circular center opening for the mounting of the hooked portions of the arched hook flanges of the flat base frame shell and a plurality of hooks protruded from a back wall thereof and equiangularly spaced around the circular center opening. The second clamping member comprises a circular center opening, and a plurality of hook holes for the engagement of the hooks of the first clamping member respectively.

Further, the detachable decorative cap shell carries a design. Further, the detachable decorative cap shell can be made having a recessed portion for the adhesion of a commercial sticker.

DETAILED DESCRIPTION OF THE PREFERRED EMBODIMENT

Referring to FIGS. 1~4, an earphone mounting structure in accordance with a first embodiment of the present invention is shown comprising an earphone 1, and a mounting device consisting of a first clamping member 2 and a second clamping member 3 and adapted for securing the earphone 1 to a cap A.

Figure 1:
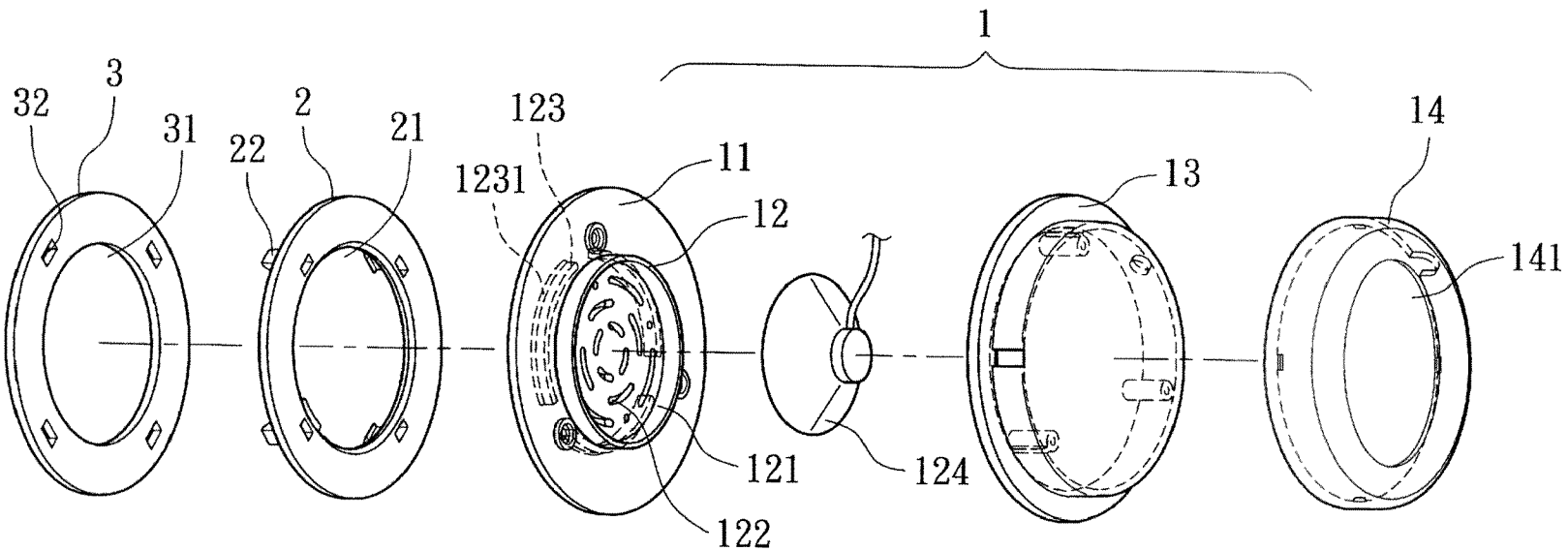
FIG. 1 is an exploded view of a headphone mounting structure in accordance with a first embodiment of the present invention.
Figure 4:
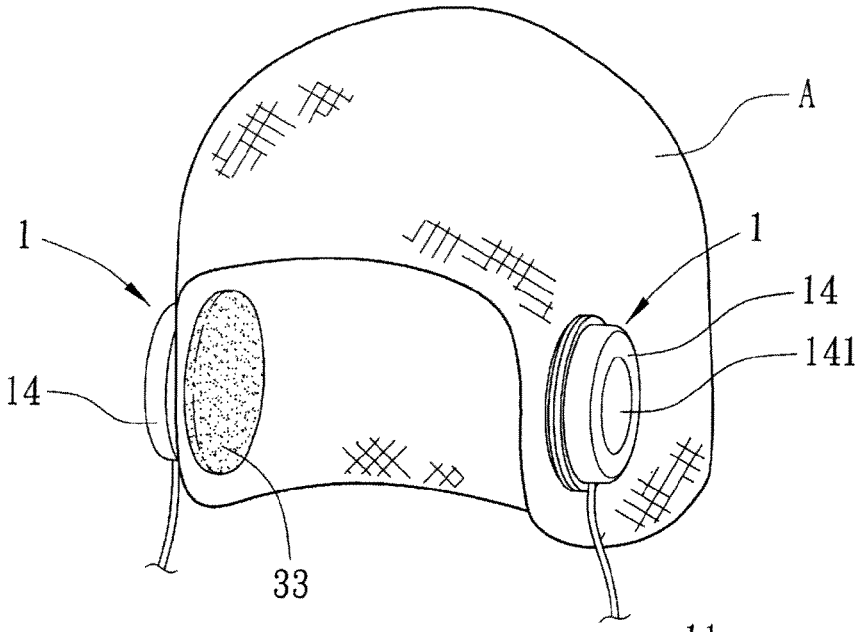
FIG. 4 is an applied view of the headphone mounting structure in accordance with the first embodiment of the present invention.
Figure 3:
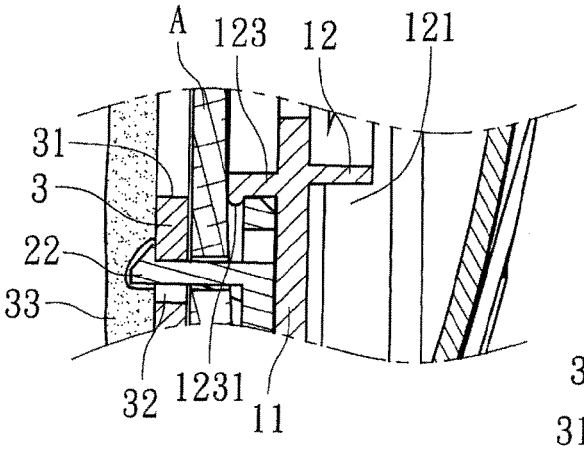
FIG. 3 is an enlarged view of a part of FIG. 2.
Figure 2:
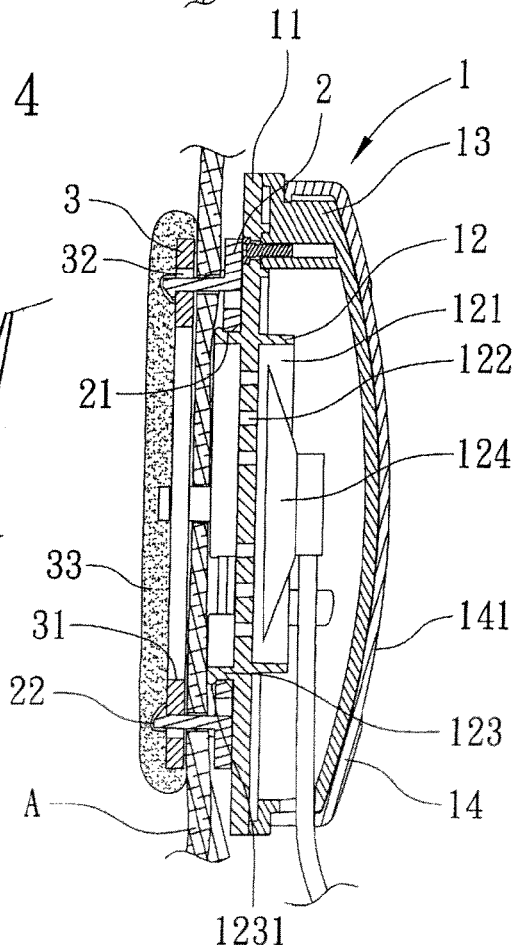
FIG. 2 is a sectional assembly view of the headphone mounting structure in accordance with the first embodiment of the present invention.
Figure 5:
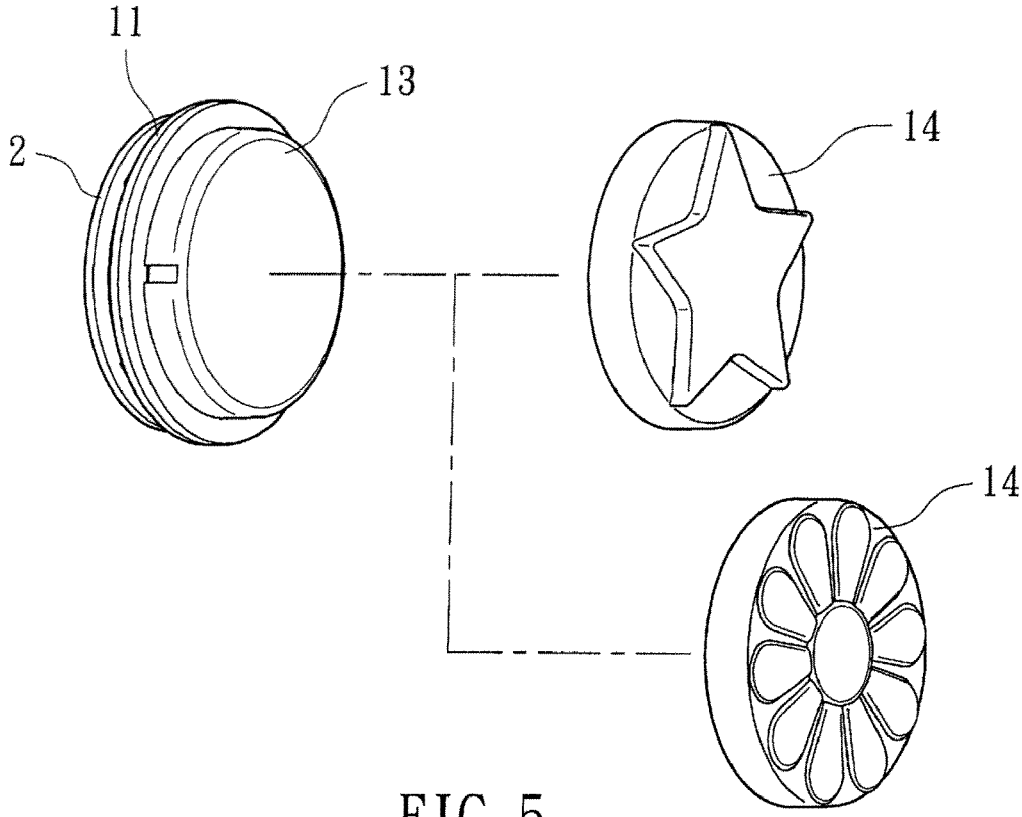
FIG. 5 illustrates different designs of detachable decorative cap shells selectively used in the headphone mounting structure in accordance with the first embodiment of the present invention.

The earphone 1 comprises a flat base frame shell 11, a speaker 124, a cover frame shell 13 and a detachable decorative cap shell 14. The flat base frame shell 11 comprises an annular flange 12 protruded from the front side thereof, a speaker accommodation chamber 121 surrounded by the annular flange 12 and adapted for accommodating the speaker 124, a plurality of sound holes 122 cut through the front and back sides thereof in communication with the speaker accommodation chamber 121, and a plurality of arched hook flanges 123 protruded from the back side thereof corresponding to the annular flange 12. Each arched hook flange 123 has a hooked portion 1231. The cover frame shell 13 is capped on the annular flange 12 and affixed to the flat base frame shell 11 by screws (not shown) to hold down the speaker 124 in the speaker accommodation chamber 121. The detachable decorative cap shell 14 is detachably covered on the cover frame shell 13, having a recessed portion 141 for the adhesion of a commercial sticker. Further, the detachable decorative cap shell 14 can be made having any of a variety of designs (see FIG. 5).

The first clamping member 2 is a flat annular member, having a circular center opening 21 and a plurality of hooks 22 protruded from the back wall thereof and equiangularly spaced around the circular center opening 21. By means of forcing the arched hook flanges 123 into the circular center opening 21 and hooking the hooked portions 1231 of the arched hook flanges 123 on the peripheral edge of the circular center opening 21, the earphone 1 and the first clamping member 2 are fastened together.

The second clamping member 3 is a flat annular member, having a circular center opening 31 and a plurality of hook holes 32 corresponding to the hooks 22 of the first clamping member 2. Further, an ear cushion 33 is attached to the back side of the second clamping member 3 for direct contact with the user's ear.

During application of the first embodiment of the present invention, fasten the earphone 1 and the first clamping member 2 together, and then attach the first clamping member 2 to the outer wall of the cap A that is a woven cap of cotton or wool threads to force the hooks 28 through the fabric structure of the cap A. and then attach the second clamping member 3 to the inner wall of the cap A to force the hook holes 32 of the second clamping member 3 into engagement with the hooks 22 of the first clamping member 2.

Figure 6:
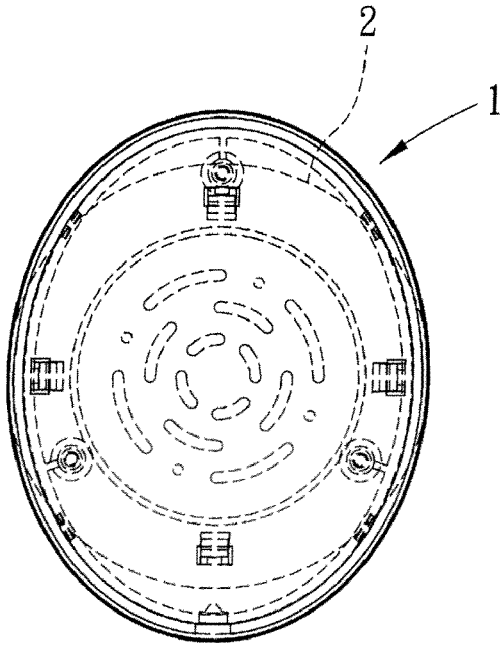
FIG. 6 illustrates an oval configuration type of the headphone mounting structure in accordance with the first embodiment of the present invention.

In the aforesaid first embodiment, the circular configuration of the earphone 1, the first clamping member 2 and the second clamping member 3 are made having a circular configuration. Alternatively, as shown in FIG. 6, the earphone 1, the first clamping member 2 and the second clamping member 3 can be made having an oval configuration.

Figure 7:
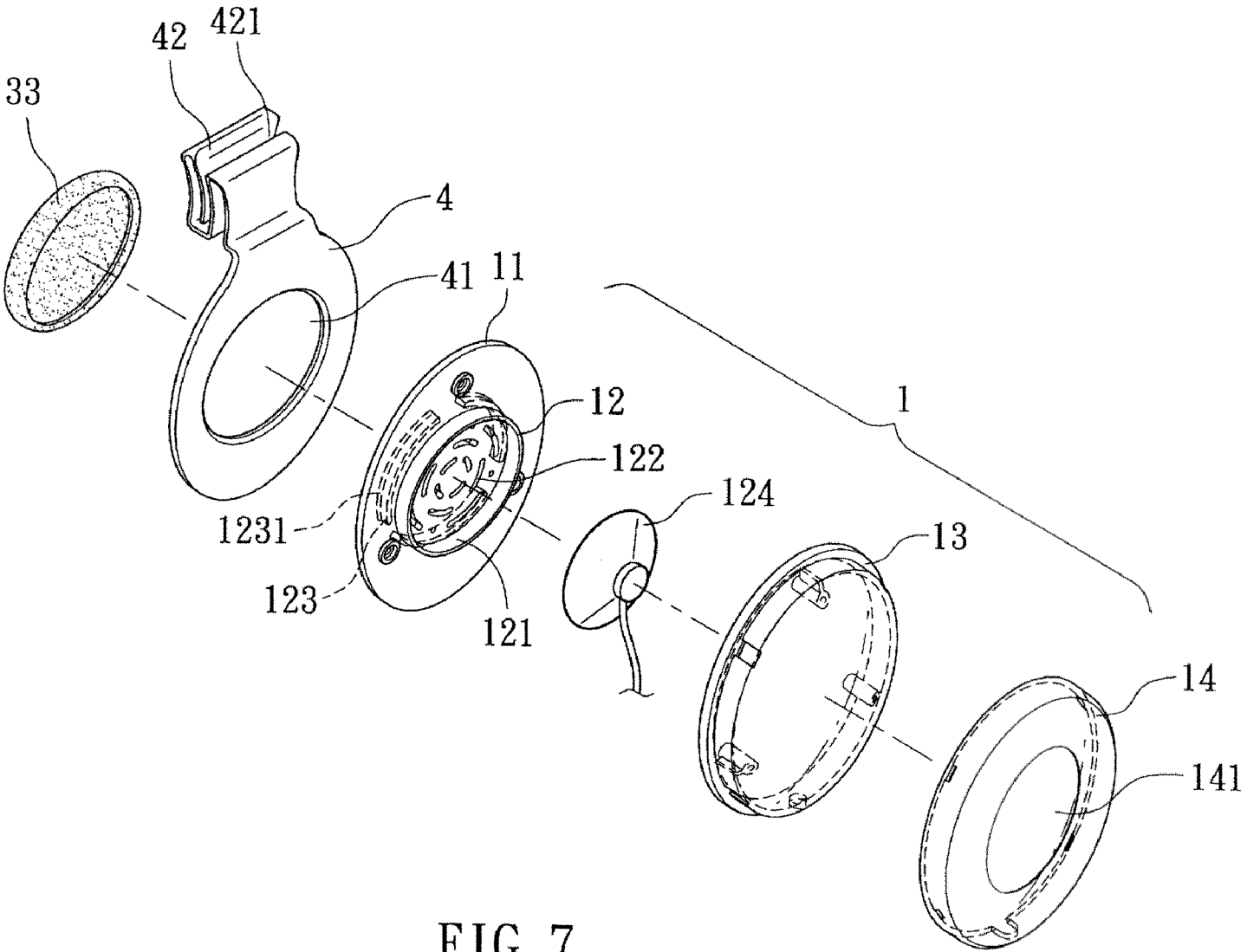
FIG. 7 is an exploded view of a headphone mounting structure in accordance with a second embodiment of the present invention.
Figure 8:
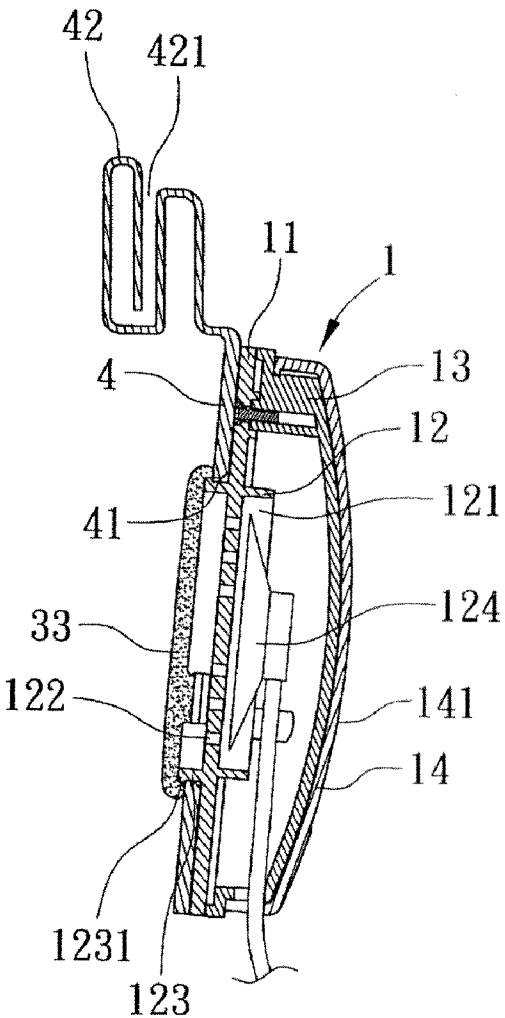
FIG. 8 is a sectional assembly view of the headphone mounting structure in accordance with the second embodiment of the present invention.
Figure 9:
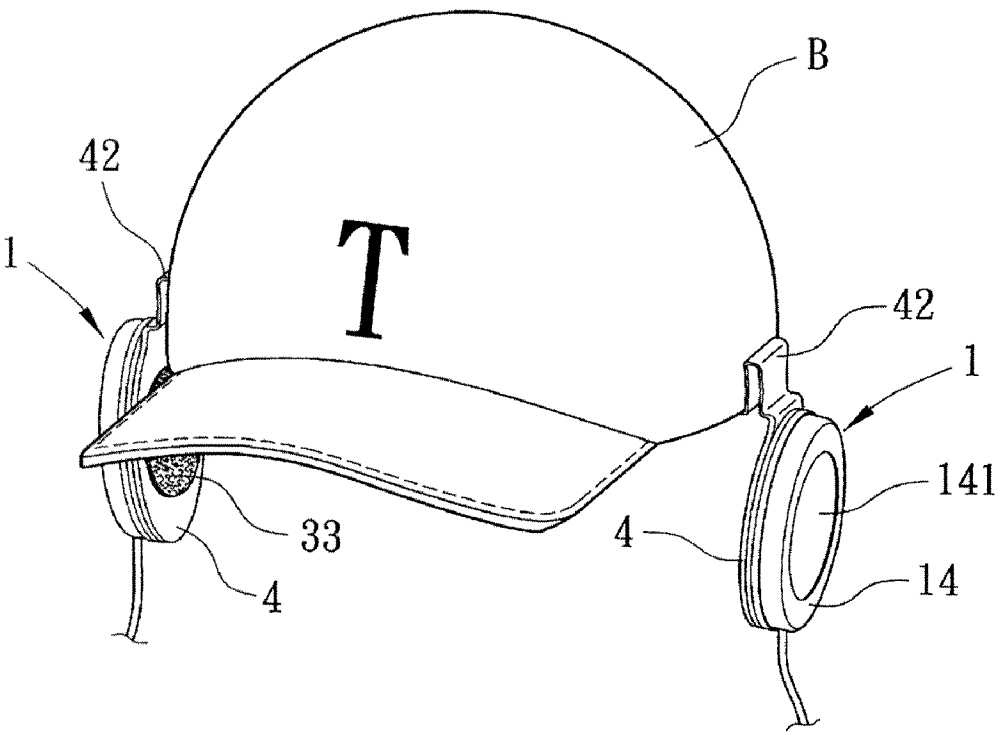
FIG. 9 is an applied view of the headphone mounting structure in accordance with the second embodiment of the present invention.

FIGS. 7~9 illustrate an earphone mounting structure in accordance with a second embodiment of the present invention. This second embodiment is substantially similar to the aforesaid first embodiment with the exception of the mounting device. According to this second embodiment, the mounting device, referenced by 4, is a single-piece member having a circular center opening 41 for the mounting of the flat base frame shell 11 of the earphone 1 and a spring clamping arm 42 extended from the periphery thereof. The clamping arm 42 defines a clamping groove 421 for fastening to the bottom edge of a cap, for example, baseball cap B.

Figure 10:
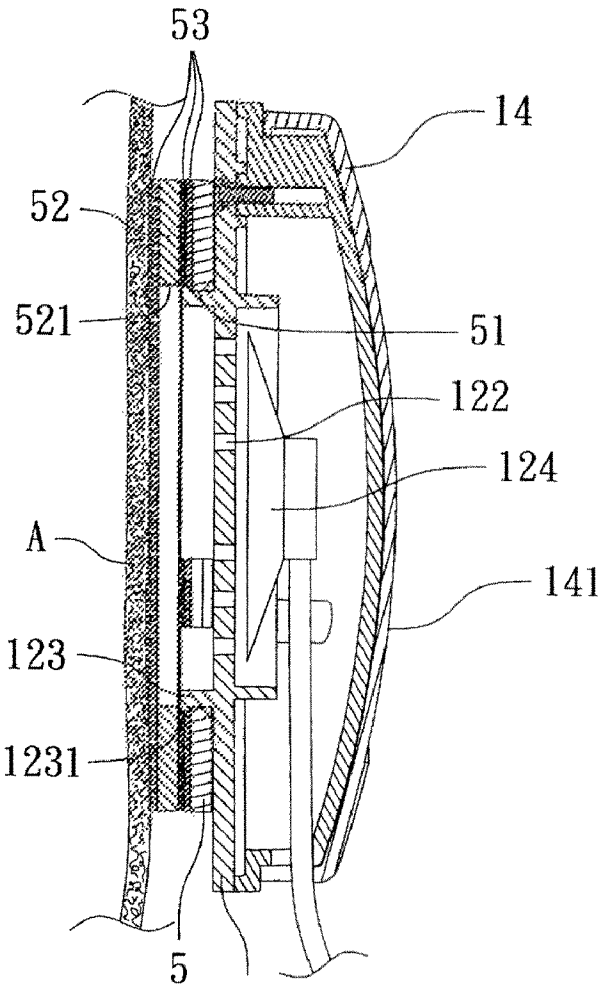
FIG. 10 is a sectional assembly view of is a headphone mounting structure in accordance with a third embodiment of the present invention.
Figure 11:
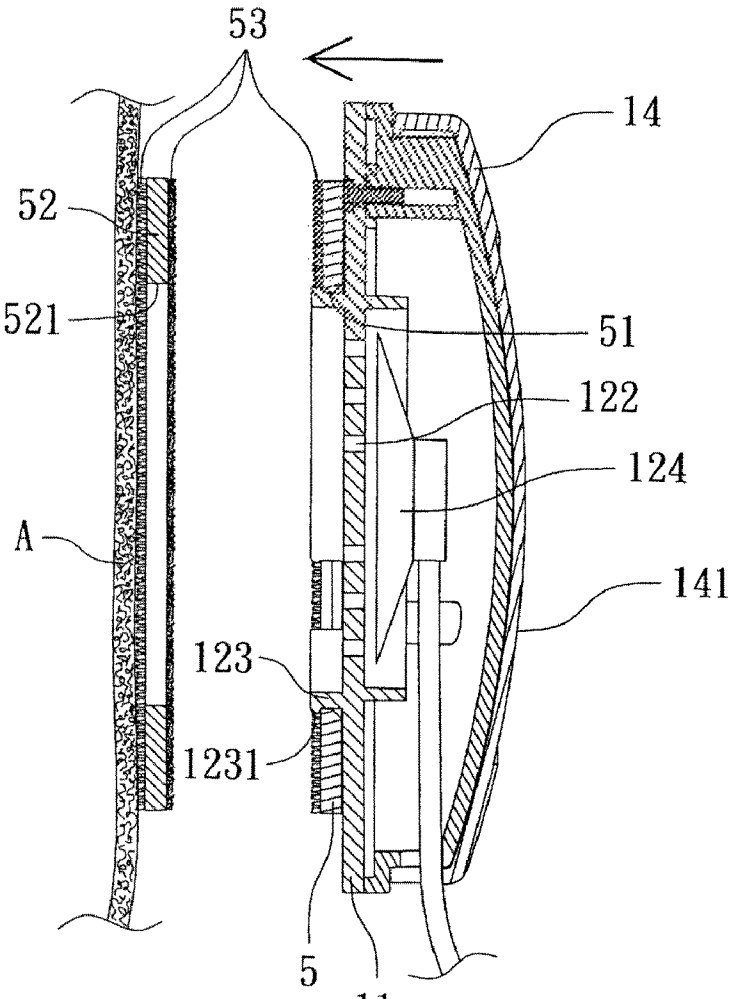
FIG. 11 is an exploded view of the headphone mounting structure in accordance with the third embodiment of the present invention.

FIGS. 10 and 11 illustrate an earphone mounting structure in accordance with a third embodiment of the present invention. This third embodiment is substantially similar to the aforesaid first embodiment with the exception of the mounting device. According to this second embodiment, the mounting device comprises a first mounting pad 5 and a second mounting pad 52. The first mounting pad 5 comprises a circular center opening 51 for the mounting of the flat base frame shell 11 of the earphone 1, and a fastening member (hook or loop material) 53 located on the back side thereof. The second mounting pad 52 can be directly stitched to a cap A or detachably secured thereto by a fastening member (hook or loop material) 53, having a fastening member (hook or loop material) 53 located on the front side thereof for the fastening of the fastening member (hook or loop material) 53 at the first mounting pad 5.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An earphone mounting structure, comprising:

an earphone, said earphone comprising a flat base frame shell, said flat base frame shell comprising an annular flange protruded from a front side thereof, a speaker accommodation chamber surrounded by said annular flange and a plurality of arched hook flanges protruded from a back side thereof corresponding to said annular flange, each said arched hook flange having a hooked portion, a speaker mounted in said speaker accommodation chamber, a cover frame shell capped on said annular flange and affixed to said flat base frame shell by screws to hold down said speaker in said speaker accommodation chamber, and a detachable decorative cap shell capped on said cover frame shell; and a mounting device adapted for securing said earphone to a cap for the head of a person, said mounting device comprising a first clamping member and a second clamping member, said first clamping member comprising a circular center opening for the mounting of the hooked portions of the arched hook flanges of said flat base frame shell and a plurality of hooks protruded from a back wall thereof and equiangularly spaced around said circular center opening, said second clamping member comprising a circular center opening and a plurality of hook holes for the engagement of the hooks of said first clamping member respectively.

2. The earphone mounting structure as claimed in claim 1, wherein said flat base frame shell further comprises a plurality of sound holes cut through the front and back sides thereof in communication with said speaker accommodation chamber.

3. The earphone mounting structure as claimed in claim 1, wherein said detachable decorative cap shell carries a design.

4. The earphone mounting structure as claimed in claim 1, wherein said detachable decorative cap shell comprises a recessed portion for the adhesion of a commercial sticker.

5. An earphone mounting structure, comprising:

an earphone, said earphone comprising a flat base frame shell, said flat base frame shell comprising an annular flange protruded from a front side thereof, a speaker accommodation chamber surrounded by said annular flange and a plurality of arched hook flanges protruded from a back side thereof corresponding to said annular flange, each said arched hook flange having a hooked portion, a speaker mounted in said speaker accommodation chamber, a cover frame shell capped on said annular flange and affixed to said flat base frame shell by screws to hold down said speaker in said speaker accommodation chamber, and a detachable decorative cap shell capped on said cover frame shell; and a mounting device adapted for securing said earphone to a cap for the head of a person, said mounting device comprising a circular center opening for the mounting of said flat base frame shell of said earphone and a spring clamping arm extended from the periphery thereof, said clamping arm comprising a clamping groove for fastening to a bottom edge of a cap for the head of a person.

6. The earphone mounting structure as claimed in claim 5, wherein said flat base frame shell further comprises a plurality of sound holes cut through the front and back sides thereof in communication with said speaker accommodation chamber.

7. The earphone mounting structure as claimed in claim 5, wherein said detachable decorative cap shell carries a design.

8. The earphone mounting structure as claimed in claim 5, wherein said detachable decorative cap shell comprises a recessed portion for the adhesion of a commercial sticker.

9. An earphone mounting structure, comprising:

an earphone, said earphone comprising a flat base frame shell, said flat base frame shell comprising an annular flange protruded from a front side thereof, a speaker accommodation chamber surrounded by said annular flange and a plurality of arched hook flanges protruded from a back side thereof corresponding to said annular flange, each said arched hook flange having a hooked portion, a speaker mounted in said speaker accommodation chamber, a cover frame shell capped on said annular flange and affixed to said flat base frame shell by screws to hold down said speaker in said speaker accommodation chamber, and a detachable decorative cap shell capped on said cover frame shell; and a mounting device adapted for securing said earphone to a cap for the head of a person, said mounting device comprising a first mounting pad and a second mounting pad, said first mounting pad comprising a circular center opening for the mounting of said flat base frame shell of said earphone and hook and loop materials located on a back side thereof, said second mounting pad being fastened to a cap for the head of a person and having hook and loop materials located on a front side thereof for the fastening of the hook and loop materials of said first mounting pad.

* * * * *